US007726356B2

(12) United States Patent
van der Lande

(10) Patent No.: US 7,726,356 B2
(45) Date of Patent: Jun. 1, 2010

(54) DEVICE FOR STORING WINE IN VACUUM

(75) Inventor: Jan van der Lande, New York, NY (US)

(73) Assignee: Kikkerland Design, Inc., New York, NY (US)

( * ) Notice: Subject to any disclaimer, the term of this patent is extended or adjusted under 35 U.S.C. 154(b) by 838 days.

(21) Appl. No.: 11/638,824

(22) Filed: Dec. 14, 2006

(65) Prior Publication Data

US 2008/0142470 A1 Jun. 19, 2008

(51) Int. Cl.
*B65B 31/06* (2006.01)

(52) U.S. Cl. ..... 141/65; 141/8; 141/60; 215/228

(58) Field of Classification Search ..... 141/8, 141/59–61, 65; 215/228
See application file for complete search history.

(56) References Cited

U.S. PATENT DOCUMENTS

| | | | | | |
|---|---|---|---|---|---|
| 3,602,387 | A * | 8/1971 | Patnaude et al. | ..... | 215/315 |
| 4,395,940 | A | 8/1983 | Child et al. | | |
| 4,684,033 | A | 8/1987 | Marcus | | |
| D296,522 | S | 7/1988 | Schneider | | |
| 4,763,803 | A | 8/1988 | Schneider | | |
| 4,889,250 | A * | 12/1989 | Beyer | ..... | 215/228 |
| 5,215,129 | A | 6/1993 | Berresford et al. | | |
| 6,502,481 | B1 | 1/2003 | Lin | | |
| 6,530,401 | B1 | 3/2003 | Angehm et al. | | |
| 6,637,321 | B2 * | 10/2003 | Wang | ..... | 99/472 |
| 6,651,834 | B2 * | 11/2003 | Wong | ..... | 215/260 |
| 6,874,545 | B1 | 4/2005 | Larimer et al. | | |
| 7,051,901 | B2 * | 5/2006 | Hickert | ..... | 222/1 |
| 7,086,427 | B2 * | 8/2006 | Bonich | ..... | 141/65 |
| 7,198,074 | B2 * | 4/2007 | Lemme et al. | ..... | 141/114 |
| 7,255,022 | B1 * | 8/2007 | Rivera | ..... | 81/3.2 |
| 7,395,942 | B2 * | 7/2008 | Michalopoulos | ..... | 141/65 |
| 2002/0117055 | A1 * | 8/2002 | Liebmann, Jr. | ..... | 99/277.1 |
| 2006/0070971 | A1 * | 4/2006 | Michalopoulos | ..... | 215/228 |

* cited by examiner

*Primary Examiner*—Gregory L Huson
*Assistant Examiner*—Nicolas A Arnett
(74) *Attorney, Agent, or Firm*—Cascio & Zervas

(57) ABSTRACT

A manually operated wine vacuum device that evacuates air from a partially filled bottle of wine or other oxygen-sensitive liquid prior to storage includes: (a) a body that defines a chamber; (b) a one-way de-aeration valve, and (c) a stopper that is adapted to be inserted into the interior of the bottle through the bottle's opening such that the interior of the bottle becomes in communication with the de-aeration valve which is configured so that gas flows into the chamber when the pressure in the chamber is lower than that of the interior of the bottle but gas does not flow into the interior of the bottle when the chamber is at a higher pressure. An open bottle abuts a collar formed in a recess region of the body as the bottle is coupled to the stopper and a piston slidably disposed within the chamber removes gas from the interior of the chamber when the piston is activated.

12 Claims, 2 Drawing Sheets

DEVICE FOR STORING WINE IN VACUUM

FIELD OF THE INVENTION

The present invention generally relates to an apparatus, for preserving the contents of a partially filled bottle containing an oxygen sensitive liquid such as wine, which evacuates air from the bottle and then seals the bottle for future consumption.

BACKGROUND OF THE INVENTION

Many liquids such as wine are susceptible to oxidation and should be protected against excessive oxidation to preserve its quality. When a bottle of table wine is opened and is only partially consumed, the portion remaining in the bottle deteriorates rapidly, even if the bottle is re-corked, because of oxidation by the oxygen that is present in the air.

A number of stopper devices are available to preserve the character of the remaining wine in the bottle that has been opened which are described, for example, in U.S. Pat. No. 4,763,803 to Schneider, U.S. Pat. No. 6,530,401 to Angehrn et al., and U.S. Pat. No. 6,874,545to Larimer et al. With these conventional devices, air is withdrawn from the bottle through elaborate channels within the stopper which are then sealed. A separate pump mechanism, which is temporarily coupled to the stopper, removes air from the bottle. These prior art devices tend to be complicated and expensive.

SUMMARY OF THE INVENTION

The present invention is based in part on the development of a simple and easy to operate, manual wine vacuum device that evacuates air from a partially filled bottle of wine or other oxygen-sensitive liquid. Once the vacuum device is mounted on the opening of the bottle through which the liquid content is poured, air is de-aerated from the bottle before the opening is sealed to retard oxidation of the liquid. The evacuation mechanism of the wine vacuum device remains coupled to the bottle during storage thereby permitting further de-aeration as needed. In one embodiment, the invention is directed to a device that is suitable for preserving the contents of a partially filled beverage bottle that includes:

a body that defines a chamber with a first end and a second end;

a one-way de-aeration valve, having an inlet and outlet, which allows gaseous flow into the chamber;

a stopper configured and adaptable to be inserted into the interior of a bottle through the bottle's opening such that the interior of the bottle is in communication with the inlet of the one-way de-aeration valve which is configured so that gas can flow into the chamber when the pressure at the outlet of the one-way valve, which is in communication with the chamber, is lower than the pressure at the inlet of the one-way, which is in communication with the interior of a bottle that is coupled to the stopper, but gas does not flow in the reverse direction from the chamber through the outlet of the one-way valve when the pressure at the outlet is higher pressure than the pressure at the inlet;

means for coupling the opening of a bottle to the stopper;

means for removing gas from the interior of a bottle that is coupled to the stopper to establish a vacuum within the bottle; and means for opening the one-way de-aeration valve to allow gas to flow into a bottle that is coupled to the stopper.

In another embodiment, the invention is directed to a device for retarding oxidation of wine or other liquid in a bottle that includes:

a housing that defines a hollow chamber that has a first end and a second end;

a biasing spring disposed within the hollow chamber;

a piston slidable disposed within the hollow chamber;

a handle that is operably connected to the piston such that operating the handle pulls the piston from the second end towards the first end of the hollow chamber;

a one-way de-aeration valve having an outlet that is in communication with the chamber and an inlet;

a stopper configured to be inserted into the interior of a bottle through its opening such that the interior of the bottle becomes in communication with the inlet of the one-way de-aeration valve; and means for opening the one-way de-aeration valve.

DETAILED DESCRIPTION OF PREFERRED EMBODIMENTS

Figure 1:
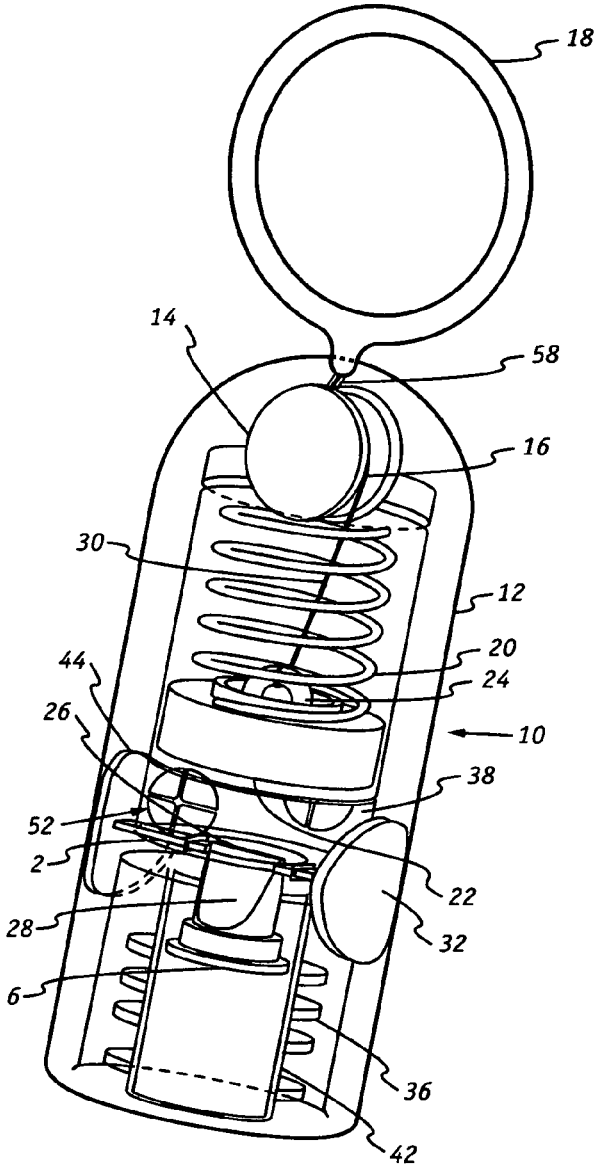
FIG. 1 is a perspective view illustrating the interior of the wine vacuum device.

Referring to FIG. 1, a wine vacuum device 10 includes a body or casing 12 that typically has a generally elongated configuration. A chamber 38 which preferably has a circular cross-section is formed within body 12. Chamber 38 has a proximal end where a stationary guide pulley 14 is disposed. A piston 22 is positioned within chamber 38 so that it can slide between the distal and proximal ends of the chamber. The outer dimensions of piston 22 are substantially the same as those of the outer contour of chamber 38 so that a relatively tight seal is maintained between the chamber interior wall and the exterior of piston 22. The lower surface of piston 22 is preferably relatively flat while its upper surface has an attachment site 24. An inelastic cord 16 is round around the groove on guide pulley 14 with its lower end 30 being secured to attachment site 24 while its upper end 58 is connected to ring handle 18. Stationary guide pulley 14 transmits and directs the force from handle 18 to piston 22. A coil spring 20 is situated between guide pulley 14 and piston 22. Pulling ring handle 18 away from body 12 causes piston 22 to draw gas away from the proximate end of chamber 38. The combination of handle 18, guide pulley 14, piston 22 and spring 20 cooperatively functions as a manual suction device. Coil spring 20 serves as a repelling spring, which counteracts against the forces that are generated by activating handle 18, to return piston 22 to its original position when handle 18 is released as further described herein. Other types of repelling springs such as a leaf spring or other springing material such as foam rubber can be employed to generate the biasing force. One or more chamber outlets or apertures 52 permit free passage of gas between chamber 38 and the exterior atmosphere.

Positioned at the lower end of chamber 38 is a one-way de-aeration valve that is configured to allow unidirectional gas flow into chamber 38. A preferred one-way de-aeration valve is a duckbill-type valve that includes a base 6 and pair of elastomeric lips 28 that are formed in the shape of a duckbill which prevent backflow and allow forward flow. The direction of gaseous flow is from an inlet aperture (not shown) that is located at base 6 toward an outlet 26 that develops at the upper edges of lips 28 when the pressure in chamber 38 is lower than the pressure at the inlet aperture. As illustrated in FIG. 1, there is no flow through the one-way valve since lips 28 are shown in the constricted or sealed configuration; however, as further described herein, when the pressure in chamber 38 decreases, aperture 26 becomes unsealed as the two elastomeric lips 28 separate from each other as gas flows into chamber 38. A preferred duckbill valve is available from Minivalve International (Yellow Springs, Ohio).

The one-way de-aeration valve can be manually opened to permit flow in the reverse direction which is employed to break the vacuum within the bottle. A spring-loaded elongated member or rod 2 is disposed on each side of the valve. The proximal end of each rod 2 is secured to one side of the two lips 28 while the distal end of each rod 2 is secured to a button 32 which is positioned in recess 44 in opposite sides of device 10. Manually pressing one or both buttons 32 causes the two lips 28 to spread apart and outlet 26 to form.

Figure 2:
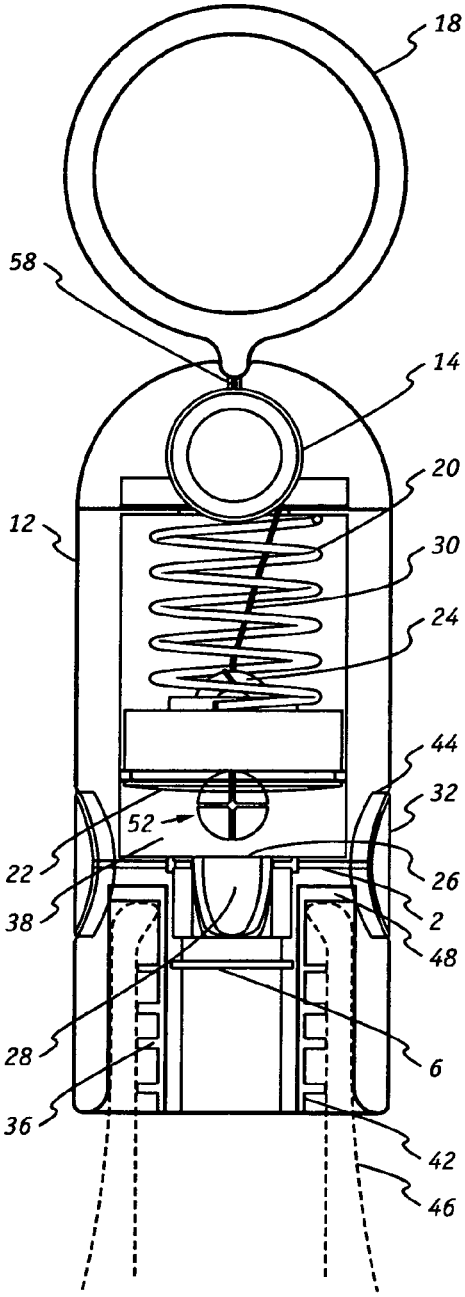
FIG. 2 is an elevational, cross-sectional view of the wine vacuum device coupled to the opening of a bottle.

Wine vacuum device 10 further includes a stopper assembly which serves to maintain a seal on wine bottle 46 once a vacuum has been established within bottle 46 as illustrated in FIG. 2. Body 12 defines a lower recess region which has a collar 48 formed at the base. The top rim of open bottle 46 abuts collar 48 which is preferably made of a pliable material such as an elastomer and is configured to engage the annular ridge on a conventional bottleneck so that a tight seal is maintained. The stopper assembly also includes stopper 42 which is an elongated member that extends part way into the interior of bottle 46 and which preferably has a circular outer contour that has one or more rings or ribs 36 formed on its perimeter. Ribs 36 are preferably made of flexible plastic and are dimensioned to provide additional structural support so the bottle and wine vacuum device 10 remain vertically aligned which reduces the likelihood that the vacuum seal will be broken should the bottle be inadvertently tilted.

Figure 3:
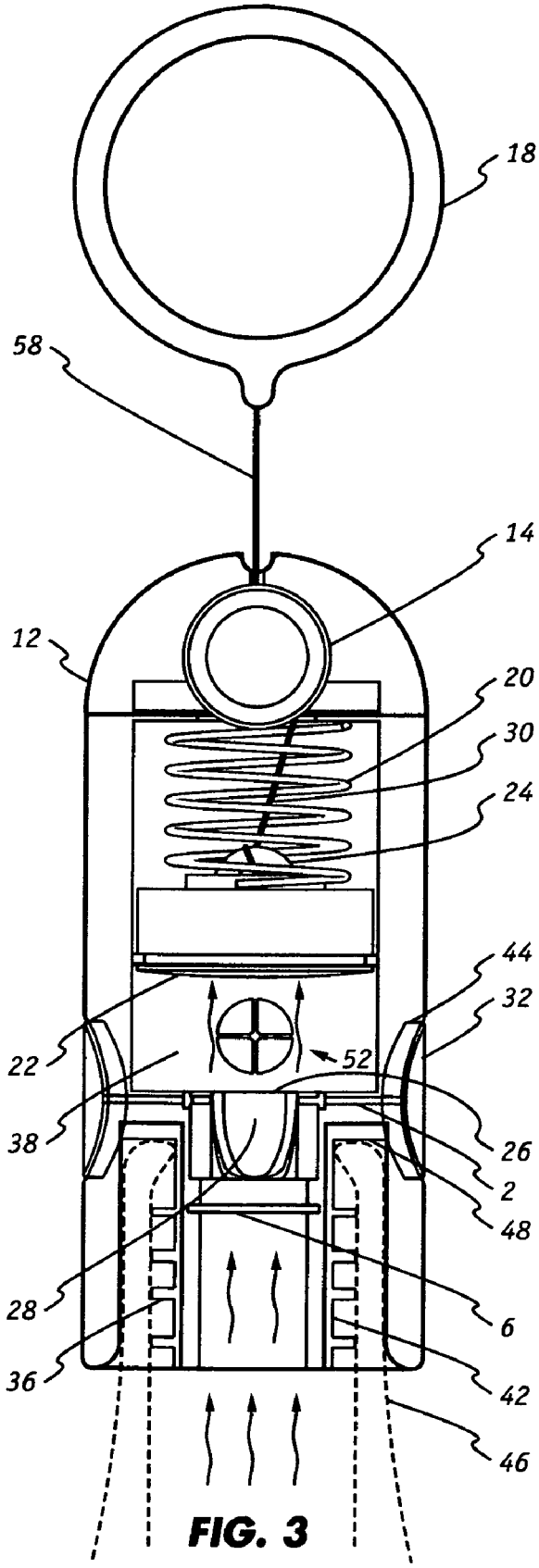
FIG. 3 is an elevational, cross-sectional view of the wine vacuum device when the suction mechanism is activated.

In operation, an open bottle 46, such as a partially consumed wine bottle, is inserted into the stopper assembly of device 10 as illustrated in FIG. 3. Handle 18 is then pulled thereby causing piston 22 to be drawn from the distal end to the proximal end to chamber 38. This action creates a suction force that causes aperture 26 of the one-way de-aeration to widen as the suction force withdraws or pulls air through aperture 26 from the interior of bottle 46 into chamber 38. Once handle 18 is released, compressed spring coil 20 expands and pushes piston 22 back to its original position at the distal end of chamber 38 as shown in FIG. 2. In the process, the return action of piston 22 expels air from chamber 38 out into the atmosphere through chamber outlet apertures 52; however, essentially no air reenters the bottle since aperture 26 of the one-way valve is now closed.

The steps of pulling and releasing handle 18 can be repeated as needed to remove sufficient air from bottle 46 to generate the desired level of sub-atmospheric pressure inside. As is apparent, the amount of air that needs to be removed until an adequate vacuum is established within the bottle is inversely proportional to the amount of wine that is present. Typically, it is necessary to pull he handle 18 only a few times; indeed, as the pressure decreases in within the bottle, the stronger vacuum therein makes each successive pulling action more difficult which is an indication that a sufficient vacuum has been established.

The de-aerated wine bottle is stored until it is ready for consumption. If the bottle is stored over a long period of time, air may seep into the bottle. To maintain the desired vacuum level, it may be desirable to periodically activate the suction mechanism by pulling and releasing handle 18. One advantage of wine vacuum device 10 is that the stopper assembly is an integral part of the device so it is unnecessary to reattach the suction mechanism to the stopper assembly. When it is time to consume the wine, buttons 32 are pressed to open aperture 26 to effectively break the vacuum within the bottle as gas from the atmosphere flow through chamber outlets 52 and into the bottle. Once pressure equilibrium is established within the bottle, the bottle can be readily de-coupled from wine vacuum device 10.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A device adaptable for preserving the contents of a partially filled beverage bottle that comprises:

a body that defines a chamber with a first end and a second end and that defines a chamber outlet;

a one-way de-aeration valve having an inlet and outlet, which allows gaseous flow into the chamber;

a stopper configured and adaptable to be inserted into the interior of a bottle through the bottle's opening such that the interior of the bottle is in communication with the inlet of the one-way de-aeration valve which is configured so that gas can flow into the chamber when the pressure at the outlet of the one-way valve is lower than the pressure at the inlet of the one-way valve, but gas does not flow in the reverse direction when the pressure at the outlet of the one-way valve is higher pressure than the pressure at the inlet of the one-way valve;

means for coupling the opening of a bottle to the stopper such that the outlet of the one-way de-aeration valve is located outside the bottle;

means for removing gas from the interior of a bottle, that is coupled to the stopper to establish a vacuum within the bottle, and which comprises a piston slidably disposed within the chamber wherein the piston is coupled to a handle such that activation of the handle pulls the piston from the second end towards the first end of the chamber to create a vacuum force within the chamber which withdraws gas from the outlet of the one-wary de-aeration valve;

biasing means for returning the piston to the second end of the chamber once the piston is released from the pull of the handle and wherein the chamber outlet is configured so that the chamber is in gaseous communication with the atmosphere that is exterior of the device even when the piston is at the second end of the chamber; and means for manually opening the one-way de-aeration valve, without having to activate the handle, to allow gas to flow into a bottle that is coupled to the stopper.

2. The device of claim 1 wherein the piston is coupled to a repelling spring such that activation of the handle creates tension in the spring sufficient to return the piston to its original position within the chamber once the piston is released from the pull of the handle.

3. The device of claim 1 wherein the stopper comprises a cylindrical member having one or more ring-shaped ribs formed on its outer circumference.

4. The device of claim 1 wherein the one-way de-aeration valve comprises a duckbill-type valve.

5. A method of preserving the contents of a partially filled beverage bottle having an opening through which the beverage can be poured that comprises the steps of:

mounting a device as defined in claim 1 onto the opening such that the outlet of the one-way de-aeration valve is located outside the bottle;

manually activating the means for removing gas from the interior of the bottle to withdraw gas from the interior of the bottle; and storing the bottle until consumption of the beverage is desired at which time, activating the means for opening the one-way de-aeration valve to allow gas to flow into the bottle.

6. The method of claim 5 wherein the beverage is wine.

7. A device for retarding oxidation of wine or other liquid in a bottle that comprises:

a housing that defines a hollow chamber that has a first end and a second end and that defines a chamber outlet that establishes gaseous communication between the chamber and the atmosphere that is exterior to the device;

a biasing spring disposed within the hollow chamber;

a piston slidably disposed within the hollow chamber;

a handle that is operably connected to the piston such that operating the handle pulls the piston from the second end towards the first end of the hollow chamber, wherein the chamber outlet is configured so that the chamber is in gaseous communication with the atmosphere even when the piston is at the second end of the hollow chamber;

a one-way de-aeration valve having an outlet that is in communication with the chamber and an inlet;

a stopper configured to be inserted into the interior of a bottle through its opening such that the interior of the bottle is in communication with the inlet of the one-way de-aeration valve and wherein the outlet of the one-way de-aeration valve is located outside the bottle; and means for manually opening the one-way de-aeration valve without having to operating the handle.

8. The device of claim 7 further comprising means for coupling the opening of the bottle to the stopper.

9. The device of claim 7 wherein the handle is connected to the piston by an inelastic cord whose direction of moving is directed by a guide pulley.

10. The device of claim 7 wherein the one-way de-aeration valve comprises a duckbill-type valve.

11. A method of retarding the oxidation of a wine or other liquid that partially fills an opened bottle having an opening which comprises the steps of:

mounting a device as defined by claim 7 adjacent the opening such that the opening is coupled to the stopper and wherein the outlet of the one-way de-aeration valve is located outside the bottle;

removing air from the bottle by manually activating the handle;

storing the bottle; and activating the means for opening the one-way de-aeration valve to allow gas to flow into the bottle.

12. The method of claim 11 wherein the beverage is wine.

* * * * *